US010397725B1

(12) United States Patent
Bharitkar

(10) Patent No.: US 10,397,725 B1
(45) Date of Patent: Aug. 27, 2019

(54) APPLYING DIRECTIONALITY TO AUDIO

(71) Applicant: HEWLETT-PACKARD DEVELOPMENT COMPANY, L.P., Houston, TX (US)

(72) Inventor: Sunil Bharitkar, Palo Alto, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/037,127

(22) Filed: Jul. 17, 2018

(51) Int. Cl.

| | |
|---|---|
| ***H04R 5/02*** | (2006.01) |
| ***H04S 7/00*** | (2006.01) |
| ***H04R 5/04*** | (2006.01) |
| ***H04R 1/40*** | (2006.01) |

(52) U.S. Cl.
CPC ..... *H04S 7/303* (2013.01); *H04R 1/403* (2013.01); *H04R 5/02* (2013.01); *H04R 5/04* (2013.01); *H04S 2400/11* (2013.01); *H04S 2420/01* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,877,098 | B1 * | 1/2018 | Riley | H04R 1/1033 |
| 9,967,693 | B1 * | 5/2018 | Seamans | H04S 7/306 |
| 2004/0218771 | A1 | 11/2004 | Chalupper | |
| 2006/0062410 | A1 * | 3/2006 | Kim | H04S 7/302 381/310 |
| 2012/0328107 | A1 | 12/2012 | Nystrom | |
| 2013/0046790 | A1 | 2/2013 | Katz | |
| 2014/0191976 | A1 * | 7/2014 | Peevers | G10L 21/10 345/173 |
| 2015/0055783 | A1 * | 2/2015 | Luo | H04S 5/00 381/17 |
| 2016/0227338 | A1 * | 8/2016 | Oh | H04S 7/303 |
| 2017/0086005 | A1 | 3/2017 | Oh | |
| 2017/0357390 | A1 * | 12/2017 | Alonso Ruiz | G06F 3/0482 |
| 2018/0262606 | A1 * | 9/2018 | Leal Mesquita | H04M 1/7255 |

FOREIGN PATENT DOCUMENTS

| | | |
|---|---|---|
| JP | 2008312113 | 12/2008 |

OTHER PUBLICATIONS

Hongmei Hu; "HRTF Personalization Based on Artificial Neural Network in Individual Virtual Auditory"; Jul. 23, 2007.
Mohammad Abdu Almarhabi; "Machine Learning Techniques for HRTF Personalization"; Jul. 2009.

* cited by examiner

*Primary Examiner* — Duc Nguyen
*Assistant Examiner* — Assad Mohammed
(74) *Attorney, Agent, or Firm* — Fabian VanCott

(57) ABSTRACT

A system for creating a perception of directionality to an audio signal, the system including: a processor with an associated memory, the associated memory containing instructions, which when executed cause the processor to: identify an audio signal and an orientation to be applied to the audio signal; calculate intermediate values to reduce the dimensions of the audio signal and orientation; provide the intermediate values into a neural network, to produce a first and second orienting audio outputs; and provide the first orienting audio output to a first speaker and the second orienting audio output to a second speaker.

20 Claims, 7 Drawing Sheets

APPLYING DIRECTIONALITY TO AUDIO

BACKGROUND

Humans use their ears to detect the direction of sounds. Among other factors, humans use the delay between the two sounds and the shadowing of the head against sounds originating from the other side to determine the direction of sounds. The ability to rapidly and intuitively localize the origination of sounds helps people with a variety every day activities, as we can monitor our surroundings for hazards (like traffic) even when we can't see the direction they are coming from.

BRIEF DESCRIPTION OF THE DRAWINGS

The accompanying drawings illustrate various examples of the principles described herein and are a part of the specification. The illustrated examples do not limit the scope of the claims.

Figure 1:
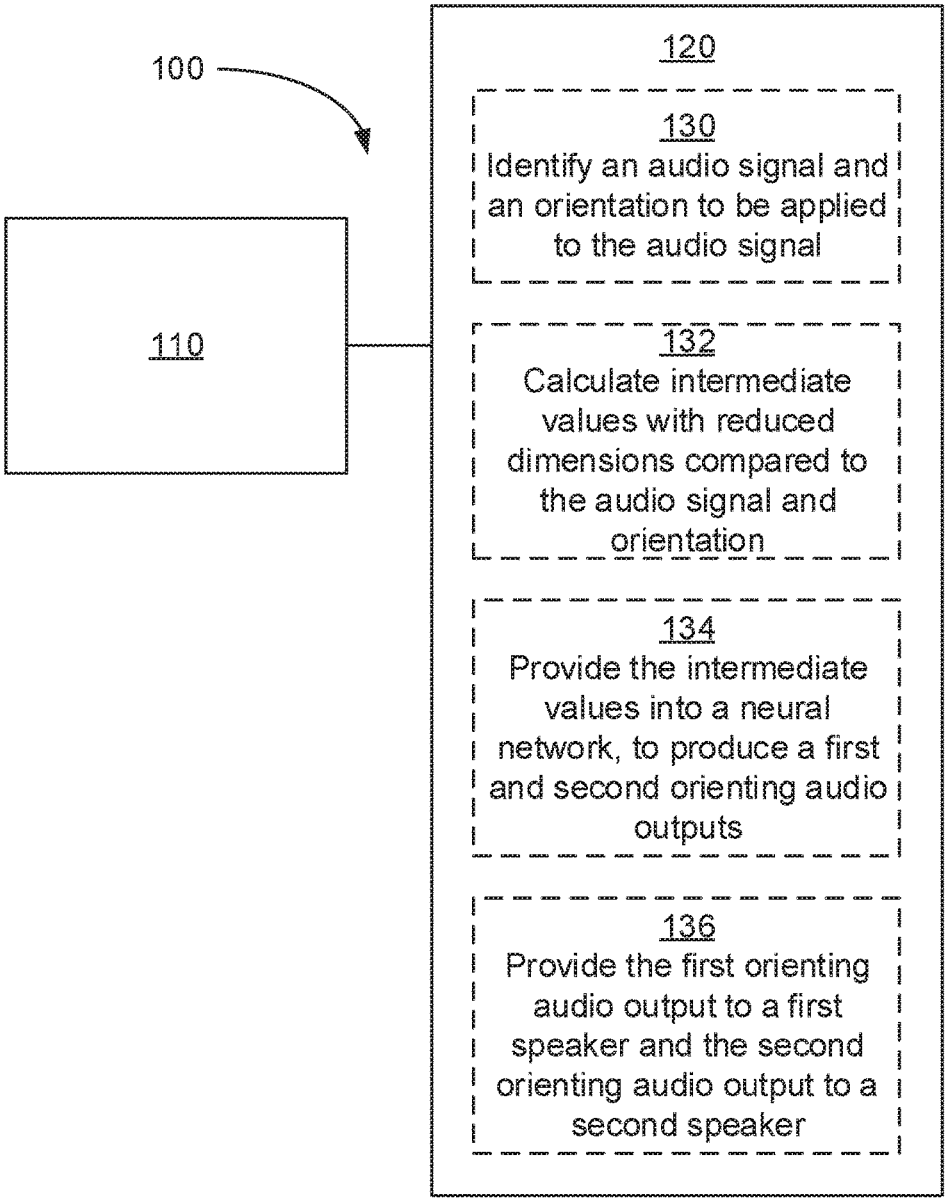
FIG. 1 describes an example of a system for creating a perception of directionality to an audio signal consistent with this specification.

Throughout the drawings, identical reference numbers designate similar, but not necessarily identical, elements. The figures are not necessarily to scale, and the size of some parts may be exaggerated or minimized to more clearly illustrate the example shown. The drawings provide examples and/or implementations consistent with the description. However, the description is not limited to the examples and/or implementations shown in the drawings.

DETAILED DESCRIPTION

Humans use their two ear hearing to localize the directions of sounds. This is a useful tool for detecting hazards, recognizing the location of others, knowing who said what, etc. However, the ability of humans to rapidly and naturally perform this operation makes simulating the experience more challenging.

Audio signal received by the two ears can be modeled using Head-Related Transfer Functions (HRTFs). A hearing transfer function translates a noise originating at a given lateral angle and elevation (positive or negative) into two signals captured at either ear of the listener. In practice, HRTFs exist as a pair of impulse (or frequency) response corresponding to a lateral angle, an elevation, and two output waveforms. The data sets corresponding to HRTF measurements are sparse, meaning they have data at intervals larger than the resolution of the median person.

The data sets are derived using a fixed noise for the input signal. In some examples, this input is a beep, a click, a white noise pulse, and/or another type of consistent noise, or a log-sweep. The data sets are generated in an anechoic chamber using a dummy with microphones at the ear position. A number of such data sets are publically available, including: the IRCAM (Institute for Research and Coordination in Acoustics and Music) Listen HRTF dataset, the MIT (Massachusetts Institute of Technology) KEMAR (Knowles Electronics Manikin for Acoustic Research) dataset, the UC Davis CIPIC (Center for Image Processing and Integrated Computing) dataset, etc.

Providing a perception of direction to an audio signal may increase the usefulness of a number of technologies. Providing the perceived direction uses two different audio signals to the ears of the listener. If the listener is wearing headphones and/or similar then speakers located near each ear may be used to provide the desired audio signal.

One use for directional audio is virtual and/or augmented reality environments. Providing direction audio may increase the realism of the environment. Providing direction audio provides an additional channel for information to be delivered to a participant. Such environments may be used for entertainment, such as games. Such environments may be used for business, such as phone conferences.

For functionality in such an environment, the delay introduced by providing an orientation to an audio signal should be short for operations to be performed quickly enough to not disrupt the user's experience. This may be less of an issue for preprogrammed environmental sounds such as ambient signals where the orientation calculations may be performed in advance. However, for speech and other directional sounds for synthesis in real-time, this presents a technical challenge. This specification describes an approach where much of the processing may be performed in advance allowing speech and/or other audio signals to be directionalized without undue delay.

In some examples, the use of a lookup to a reference produces an unacceptable delay in the processing of the audio signal. The described systems and methods may be performed without a lookup so as to provide a predictable and acceptable maximum delay.

In an example, this specification describes: a system for creating a perception of directionality to an audio signal, the system including: a processor with an associated memory, the associated memory containing instructions, which when executed cause the processor to: identify an audio signal and an orientation to be applied to the audio signal; calculate intermediate values to reduce the dimensions of the audio signal and orientation; provide the intermediate values into a neural network, to produce a first and second orienting audio outputs; and provide the first orienting audio output to a first speaker and the second orienting audio output to a second speaker.

This specification also describes a system for creating a perception of directionality to an audio signal, the system including: a processor with an associated memory, the associated memory containing instructions, which when executed cause the processor to: identify an audio signal and an orientation to be applied to the audio signal; calculate intermediate values to reduce the dimensions of the audio signal and orientation; provide the intermediate values into a neural network, to produce a first and second orienting audio outputs; and provide the first orienting audio output to a first speaker and the second orienting audio output to a second speaker.

This specification also describes a system for creating a perception of directionality to an audio, the system including: a processor with an associated memory, the associated memory containing instructions, which when executed cause the processor to: identify an audio signal and an orientation to be applied to the audio signal; calculate intermediate values to reduce the dimensions of the audio signal and orientation; provide the intermediate values into a neural network, to produce a first and second orienting audio outputs; delay the first orienting audio output relative to the second orienting audio output and provide the first orienting audio output to a first speaker and the second orienting audio output to a second speaker, wherein intermediate values are calculated from a hypercube vertex map produced by stacked encoders processing a augmented data set of audio inputs and wherein the sparse data set is augmented by applying an augmenting routine to the data set prior to processing by the stacked encoders.

This specification also describes a computer software product comprising a non-transitory, tangible medium readable by a processor, the medium having stored thereon a set of instructions for establishing a similarity correspondence between an input document and one or more documents in a base document collection, the instructions including: a set of instructions which, when loaded into a memory and executed by the processor, cause the processor to identify an audio signal, an orientation to be applied to the audio signal, and a distance; a set of instructions which, when loaded into a memory and executed by the processor, cause the processor to calculate intermediate values to reduce the dimensions of the audio signal and orientation; a set of instructions which, when loaded into a memory and executed by the processor, cause the processor to provide the intermediate values into a neural network, to produce a first and second orienting audio outputs; a set of instructions which, when loaded into a memory and executed by the processor, cause the processor to modifying the first orienting audio output and the second audio output based on the distance; a set of instructions which, when loaded into a memory and executed by the processor, cause the processor to delay the first orienting audio output relative to the second orienting audio output; and a set of instructions which, when loaded into a memory and executed by the processor, cause the processor to provide the first orienting audio output to a first speaker and the second orienting audio output to a second speaker, wherein intermediate values are calculated using components of a principle component analysis of a blurred, augmented data set of audio inputs.

Turning now to the figures, FIG. 1 describes a system (100) for creating a perception of directionality to an audio signal, the system including: a processor (110) with an associated memory (120), the associated memory (120) containing instructions, which when executed cause the processor (110) to: identify an audio signal and an orientation to be applied to the audio signal (130); calculate intermediate values with reduced dimensions compared to the audio signal and orientation (132); provide the intermediate values into a neural network, to produce a first and second orienting audio outputs (134); and provide the first orienting audio output to a first speaker and the second orienting audio output to a second speaker (136).

The system (100) is a system (100) for creating a perception of directionality to an audio signal. The system takes an audio input and an orientation and creates two audio outputs which, when played to the ears of a user, create the impression of directionality to the sound.

The processor (110) may be a single processor. The processor (110) may include multiple processors (110), for example, a multi-core processor (110). The processor (110) may include multiple processors (110) in multiple devices. The processor (110) may be a server and/or another device associated with a network. The processor (110) may be remote from a user. The processor may be local to a user.

The associated memory (120) is accessible by the processor (110) such that the instructions from the associated memory (120) are processed by the processor (110) to perform the described operations. The associated memory (120) may be stored locally. The associated memory (120) may be accessed over a network. The instructions may be present in their entirety in the associated memory (120). The instructions may be loaded into the associated memory (120) from a data storage device. In an example, portions of the instructions are loaded as needed from the storage device. The associated memory (120) may be a data storage device. Recent trends in computing system continue to blur the difference between memory such as RAM and/or ROM and storage including solid state drives (SSD).

The processor (110) identifies an audio signal and an orientation to be applied to the audio signal (130). The audio signal may be in a packet. The audio signal may be packetized. The audio signal may be preprocessed before performing the calculations to reduce the number of dimensions.

In an example, the audio signal is passed through a fast Fourier transform (FFT) to convert the audio signal from a time domain to frequency domain. The frequency domain may then be partitioned into a number of channels. In each zone, a magnitude may be extracted. In an example, the number of channels is a power of 2, for example, 128 or 64. The audio signal may be subjected to additional filtering and/or processing, for example, to remove background noise.

The orientation may be expressed as a sign, an angle, an elevation angle, and an elevation sign. In an example, an angle of zero is directly ahead with positive values going one direction, e.g. right, and negative values going the other direction, e.g. left. Because of symmetry, the sign may be dropped from the signals being input into the intermediate calculations and then used at the end to determine which output is the first orienting audio output and which output is the second orienting audio output. This increases the power of the neural network by reducing the number of redundant pathways for the right/left sides based on the system's symmetry. Effectively, all orientations are treated as coming from a single generic side and then assigned to right or left at the end of the process. The added benefit of mapping the input orientation lying between 0 degrees and 360 degrees (for both azimuth and elevation) to a unit hypercube is that the neural network is trained on this normalized (viz., encoded) input direction values as opposed to actual direction values is that this hypercube approach prevents the neural network neurons from operating in the saturation region when operating on un-normalized large direction values (which inherently limits the training performance).

The processor (110) calculates intermediate values with reduced dimensions compared to the audio signal and orientation (132). The values of the audio signal and the orientation are used to calculate intermediate values. The intermediate values have reduced dimensions compared with the audio signal and the orientation. In an example, the intermediate values are compressed to 6, 8, or 16 values. The number of intermediate values may be a factor of 2. The number of intermediate values may be optimized by trial and error. Increasing the number of intermediate values may increase the quality of the orienting audio outputs. Increasing the number of intermediate values may increase the total processing time and/or processing resources.

For example, if the intermediate values are components from a principle component analysis, the intermediate values may be described as sums of the product of weightings and input values. In an example, weightings with an absolute value below a threshold may be dropped from the calculations. Weightings with a value below a relative value of the largest weightings may be dropped from the calculations. For example, weightings below 1/1000th of the largest factor may be dropped. Weightings with an impact below the noise floor for the audio signal may be dropped from the calculations. In an example, a fixed number of weightings are used with the remainder being zeroed. These kinds of simplifications may reduce the processing time and/or calculate the intermediate values without impacting the quality of the output.

The use of a fixed number of weightings and/or a maximum number of weightings may avoid the need for comparison operations, further speeding up the calculations.

In an example, the augmented HRTF set is first reduced in dimensionality, to a lower-dimensional space, using principal component analysis (PCA) for fast training of the ML model. The PCA is performed individually on the ipsilateral and the contralateral HRTFs using singular value decomposition (SVD) of the augmented HRTF data set. The SVD yields the orthonormal matrices, the eigenvector matrix, and the singular value diagonal matrix for each of the matrices. These matrices are each organized with, for example, m=1024 FFT-bins. The principal component coefficients correspond to the eigenvectors with M largest singular values of the matrix. The reconstruction performance may be assessed.

In an example, the augmented HRTF set may be first reduced in dimensionality using stacked sparse autoencoders which are pretrained using a linear weighted combination of (a) a mean-square error term between the input and the estimated input (at the output of the decoder), (b) Kullback-Liebler divergence measure between the activation functions of the hidden layers and a sparsity parameter to keep some of the hidden neurons inactive some or most of the time), and (c) with an L2 regularization on the weights of the autoencoder to keep them constrained in norm. Adding a term to the cost function that constrains the values of ρ hidden to be low encourages the autoencoder to learn a representation, where each neuron in the hidden layer fires to a small number of training examples. Other autoencoder optimization functions involving, for example, restricted Boltzmann machines (RBM) are also feasible. The compressed values, at the output of the deepest encoder layer, are subsequently used for reconstructing the HRTFs at arbitrary directions.

The processor (110) provides the intermediate values into a neural network, to produce first and second orienting audio outputs (134). The neural network has been trained based on the data sets to produce the first and second orienting audio outputs.

The function approximation, may be performed using a multilayer fully-connected neural network (FCNN) for developing the subspace synthesis model due to its universal approximation properties (e.g., single hidden-layer, multi-hidden layer). The input to the neural network is the direction of the HRTF and the output vector corresponds to the M principal components, or in the case of stacked autoencoders the output of the FCNN is a lower-dimensional compressed representation. The direction input may be transformed initially to binary form with the actual values mapped to the vertices of a q-dimensional hypercube in order to normalize the input to the first hidden layer of the artificial neural network (ANN). In an example, the input space is transformed to a binary representation having 9-element input layer for the horizontal and elevation directions. Among the various training approaches, gradient descent with momentum term and adaptive learning rate providing an acceptable balance in terms of convergence time and approximation error on the training data.

In one example, the multilayer neural network used two hidden layers involving 29 and 15 neurons in the first and second hidden layer, respectively, to perform function approximation over the training set comprising the input direction (with 9 input neurons for the "8-bit+MSB sign bit" binary directional representation and 44 horizontal directions) and output comprising the 6 principle components (PC). Each of the hidden and output neurons use the tanh ( ) function since the maximum of each of the PC over all directions is 2 and minimum is 2. For an arbitrary input direction, not in the training set, the HRTF synthesis is performed using this neural network to the estimated PC output.

In an example of the stacked encoder approach, the number of stacked autoencoders used was set to two for first achieving a compression from 1024 FFT bins to 64 values and then from 64 dimension-representation down to 6-dimensional representation in the encoder part (this allows comparison against the PCA-based approach described earlier which used M=6 principal components) with the sparsity proportion set to 0.8 for the first encoder and 0.7 for the second encoder. The multilayer neural network had the same number of hidden layers (and activations) as in the PCA-FCNN case to perform function approximation over the training set comprising the input direction with output comprising the M=6 compressed estimates for the decoders of the stacked autoencoder.

In an example, the side information from the orientation is recombined to assign the first and second orienting outputs.

The processor (110) provides the first orienting audio output to a first speaker and the second orienting audio output to a second speaker (136). The first and second speakers may be located near the first and second ears of a user. The first and second speakers may be located on opposite ears of a user. The first and second speakers may be in a pair of headphones and/or earbuds. The first and second speakers may be integrated into a system with a visual display for one and/or both eyes of the user. The speakers may be integrated into a virtual reality (VR) headset and/or an augmented reality (AR) headset.

The neural network outputs may be mixed with the original audio signal prior to provision to the first and second speakers. The first and second orienting outputs may be subjected to additional processing prior to provision to the first and second speakers (136). The orienting outputs may be modified to indicate distance. The orienting outputs may be modified to reflect intervening dampening materials. The orienting outputs may be modified to reflect sound absorption and/or reflection from the environment. In an example, the system outputs a Head Related Transfer Function (HRTF) transfer function for each output which is then convolved with the original audio signal prior to produce the first and second orienting outputs provided to the speakers. The system may output the first and second orienting outputs already mixed with the original audio signal. The first and second orienting outputs may be HRTFs. The first and second orienting outputs may be convolutions of HRTFs with the original audio signal. The first and second orienting outputs may be convolutions of the HRTFs with the original audio signal and additional post processing.

The first and second orienting outputs may be provided in a time synchronized manner. The first and second orienting outputs may be provided with a delay to the offside output. I.e., if the sound is from the right side at 30 degrees, the orienting output to the left ear may be delayed. In an example, the processor delays the first orienting audio output relative to the second orienting audio output.

There are tradeoffs to adding the delay in using a secondary process vs. allowing the neural network to calculate the delay. Allowing the neural network to perform this determination reduces the need for a separate, secondary process. The outputs from the neural network may be considered the proximal side and distal side to avoid the left/right redundancy. Calculating the delay is reasonably predictable using the speed of sound and the head width. Including this determination in the neural network uses additional resources by the neural network that could be used for producing the output waveform/frequency spectrum instead of using these resources/nodes to calculate the delay. Keeping the delay as a separate operation also allows the system to be dynamically adjusted to different sized heads, although without the frequency specific shifts which may vary with head size.

In an example, the system identifies an ear to ear separation value and uses the separation value to calculate the delay. This separation may be adjusted by a user over time via a learning and/or feedback program. This separation may be measured by a set of headphones. In an example, the orientation of the first speaker and the orientation of the second speaker are provided to the processor. The separation of the first and second speakers may be provided to the processor.

For example, the headphones, earbuds, helmet, etc. may include an orientation sensor on each ear as well as a separation sensor. The separation sensor may be a calibrated electromagnetic and/or acoustical, including outside the human perception range, signal which is detected by a sensor on the other ear. The two ear pieces may chirp to each other to determine information about the auditory characteristics, for example, the amount of absorption and/or echoing, of the local environment. In an example, the system may detect removal of one sensor from an ear, for example, due to a change in separation over a threshold and/or change in orientation, and shift from two audio output channels to single channel audio until the second earpiece is restored.

In an example, the intermediate values are calculated from a hypercube vertex map produced by stacked encoders processing an augmented data set of audio inputs.

In another approach, intermediate values are calculated from components of a principle component analysis (PCA) of an augmented data set of audio inputs.

Either of the described approaches above may be applied to a sparse data set. The approaches may also be applied to an augmented data set. Augmenting the data set may increase the smoothness and continuity of the output.

The sparse data set may be augmented by interpolating values between the sparse values of the data set. This provides some relevant benefits compared with the use of the sparse data set to perform the analysis. Principle component analysis (PCA) is an effective method of identifying covariation within a system. However, PCA is not particularly effective at identifying constraints which apply to all the data points. PCA does not include a smoothness and/or continuity assumption. This may tend to result in the PCA being less effective at predicting smooth behavior between data points in non-clustered data. Similarly, PCA's lack of a continuity assumption may result in less reliability between data points. Interpolating, in contrast, is effective with smooth and continuous variables. Interpolating is computationally efficient. Using interpolation to fill in points between the sparse data points has the effect of bootstrapping in the smoothness and continuity assumptions of interpolation into the PCA. For the head related transfer functions (HRTFs) both smoothness and continuity are good assumptions which increase the stability and accuracy of the generated model.

The spacing of the interpolated augmented data points may depend on the resolution of a median and/or mean person in that region of the HRTF. For example, if the mean resolution is 1 degree then the interpolated data points may be generated at a value based off of the mean value. In an example, the spacing of the interpolated data points is equal to the mean value. The spacing may be the mean value multiplied by a safety factor, such as ½ or ⅓. In an example, the spacing of the interpolated data points is the mean minus one standard deviation. In an example, the spacing of the interpolated data points is the mean minus two standard deviations, i.e., 97.5% population value. Finally, the spacing may be selected by a distribution value, such that the spacing covers 50%, 90%, 99%, or some other percentage of the population. Because the calculations associated with the interpolated data points maybe performed in advance, increasing the number of interpolated points does not have a direct impact on the processing speed to orient an audio signal to a direction. Accordingly, the cost of increasing the density of interpolated values is on the preprocessing and training time, not on the response time.

Principal component analysis produces an eigenvector of components. Each component is a linear combination of the input variables. The components may be ordered in terms of impact on the output variable(s) with the largest components being first. The number of relationships in the eigenvector is equal to the number of input variables. However, since the correlation and predictive value is concentrated, by the PCA into the largest components, it may be useful to use a subset of the largest components rather than all the components produced by the PCA. In practice, the smaller variables tend to contain noise more than repeatable information.

Using a 128 channel output of the Fast Fourier Transform (FFT) of the audio and an 8 bit orientation value as inputs into the PCA, the use of the largest 6 channels provides a good balance between accuracy and speed of calculation. Plotting the number of components vs. final, i.e., "true" value shows a knee at 4 components and with the result approaching a limit afterwards. Accordingly, while use of less than 4 components would likely be suboptimal, the returns after 6, 8, or 16 components are decreasing. In some cases, it may useful to use 8, 16, or 32 components to provide comparison to the stacked encoder method.

Augmentation of the sparse input set may similarly be performed prior to using stacked encoders. As with the PCA approach above, this has the practical effect of baking in the smoothness and continuity assumptions into the system. While continuity and smoothness are not suitable assumptions for all data sets, for the audio response described by the HRTFs, both assumptions may increase the accuracy of the outputs.

In an example, the orientation information is provided to the neural network while the audio signal is being transformed from time domain to the frequency domain using a fast Fourier transform (FFT). The intermediate variables may be provided as a group. The intermediate variables may be provided sequentially as they are calculated. The system (100) may use multiple processors (110) to calculate the intermediate variables simultaneously. The system (100) may use a single processor (110) and calculate the intermediate variables sequence. The order of calculation of the intermediate variables may be fixed. The order of calculation of the intermediate variables may vary depending on the orientation information. For example, if a first orientation is dominated by a first intermediate variable and a second orientation is dominated by a second intermediate variable, the system may first calculate the intermediate variable with the greatest relevance before proceeding to calculate less impactful intermediate variables. In some examples, this approach reduces the total time to perform the orientation of the audio signal.

The sparse data set may be augmented by applying a blurring function to the data points prior to processing to form the matrix and/or extract the principle components.

Given that the human auditory resolution is tuned for discriminating sources with a localization blur that is lower bounded on critical test stimuli at 1 degree intervals in the frontal direction, many datasets constitute sparse datasets. Estimates of localization blur relative to the median plane vary but range from sub 1 degree to, perhaps, 10 degrees. The distribution is not symmetrical and a median value may be around 2 degrees. Furthermore, from the compilation of the results in, a directional perspective to localization blur is shown in FIG. 1, wherein the auditory system is able to discriminate sources within 3 degrees in the front, while the sensitivity decreases by +/−6 degrees to the side and it decreases by +/−3 degrees to the rear. A sparse dataset benefits from an interpolation scheme that is derived from perceptual cues based on the spatial sensitivity of human hearing, e.g., localization blur.

To augment the spare data set and perform the localization blur, a difference is determined between consecutive HRTF magnitude responses whose envelope is then approximated by a second order discrete time-domain infinite impulse response (IIR) filter. This may be expressed as:

$H_{blur}(z)=10\hat{}(G/20)*$(summation from $k=0$ to $k=2$ of $(b_k*z\hat{}-k)$)/(summation from $k=0$ to $k=2$ of $(a_k*z\hat{}-k)$) where $b_i=\gamma 1(f_c, f_s, G)$, $ao=1$, $a_i-\gamma 2(F_c, F_s)$, $f_c$ is the −3 dB frequency, G controls the gain in dB, $f_s$ is the sampling frequency, and $\gamma_1$ and $\gamma_2$ are nonlinear functions.

Alternative models for such filters, also referred to as shelf filters, can be used. In an example, an envelope-approximating shelf filter uses an fc of 2 kHz and a G of 3 dB. The envelope, between two consecutive HRTF sets, may be interval-stepped in a non-uniform manner predicated on the non-linear spatial auditory resolution. This non-uniform manner may be based on the mean localization blur values at the corresponding orientation, which is finer in the frontal and rear direction and less refined towards the sides. The HRTFs from the sparse set are merged with the augmented set to create a system of HRTFs for use in the subsequent machine learning (ML) model. While the finer details, such as spectral notches width, frequencies, and amplitudes may be omitted for the augmented set, in contrast to the envelope. The ML model may synthesize these finer representations which may be relevant for localization. Accordingly, the constructed points use to augment the data set may contain less data than the measured data points, but they are capable of guiding the ML model without being fully developed points. This ability of the ML model to integrate reconstruction based on the details of the measured points and the general response profile of the blurred points provides an effective way to achieve higher resolution without having to measure each orientation at below the human resolution in order to produce effective orientation of audio signals.

Figure 2:
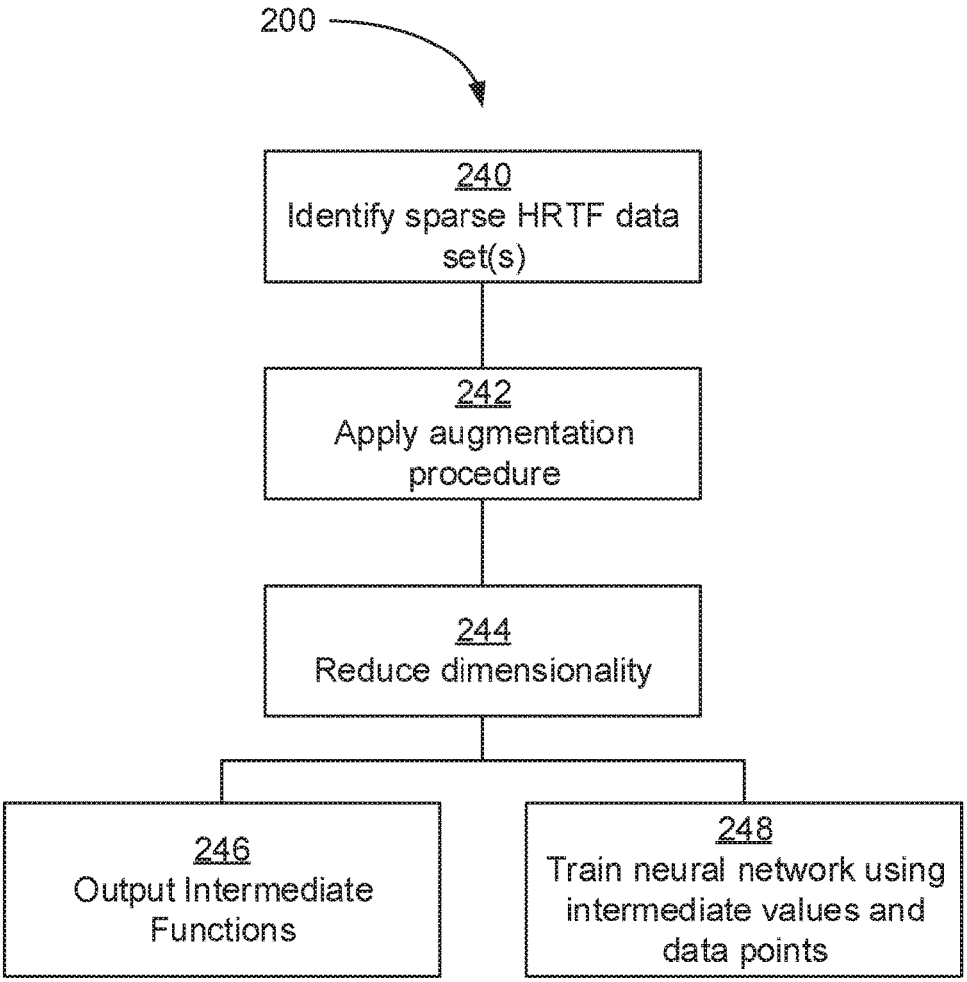
FIG. 2 shows a flowchart of a process of training the neural network consistent with the present specification.

FIG. 2 shows a flowchart of a process (200) for training the neural network consistent with the present specification. The process (200) includes: identifying sparse HRTF data set(s) (240); applying augmentation procedure (242); reducing dimensionality (244); outputting intermediate functions (246); and training neural network using intermediate values as output and corresponding orientation/direction as input data points (248).

The process (200) is a process for training the neural network. Once trained, the neural network provides intermediate values for conversion into the HRTF outputs. A variety of neural network configurations can be used. However, a fully connected neural network with an increasing weight function for each additional neuron has been found to provide a suitable balance in training time, size, and processing time.

The augmented HRTF set is reduced in dimensionality using stacked sparse autoencoders which are pretrained using a linear weighted combination of (a) a mean-square error, term between the input and the estimated input (at the output of the decoder), (b) Kullback-Liebler divergence measure between the activation functions of the hidden layers and a sparsity parameter (ρ) to keep some of the hidden neurons inactive some or most of the time), and (c) with an L2 regularization on the weights of the autoencoder to keep them constrained in norm. In an example, the cost function E of the weights W may be represented by:

$$E = \frac{1}{N}\left(\sum_{k=1}^{N}\left\|\underline{X}_k - \underline{\hat{X}}_k\right\|_2 + \alpha\Omega_{KL}(\rho\|\hat{\rho}_{hidden})\right) + \beta\|W\|$$

Details on this cost function may be found in: Moller, M. F. "A Scaled Conjugate Gradient Algorithm for Fast Supervised Learning", Neural Networks, Vol. 6, 1993, pp. 525-533 and/or Olshausen, B. A. and D. J. Field. "Sparse Coding with an Overcomplete Basis Set: A Strategy Employed by V1." Vision Research, Vol. 37, 1997, pp. 3311-3325.

The process (200) includes identifying sparse HRTF data set(s) (240). This approach may be applied using a single sparse data set. This approach may be applied with multiple overlapping data sets. When the multiple data sets are combined, a decision about the relative weighting of the data sets may be considered. If all the data sets have the same number of data points prior to augmentation and all have a second number of data points after augmentation then the weighting is unchanged by augmentation. However, this is rarely the case. Instead, the number of data points after augmentation is dependent on the spacing used for the interpolated points. This spacing may be selected to be the same for each of the data sets in a given region. For example, after augmentation, each data set may have a data point at 1 degree intervals in the forward 90 degree (+/−45 degree) arc. This weights each data set equivalently. However, if the input data sets have unequal numbers of points, it may be useful to deweight data sets with fewer data points. One method to do this is to apply a scaling factor to at least one data set. The scaling factors may be implemented by introducing true replicates of the data sets.

For example, if data set A has 3× data points and data set B has 5× data points in the original arc. After calculating the intermediate augmented, two copies of the augmented data set A may be added to the combined data set (for a total of 3) and four copies of the augmented data set B may be added to the combined data set (for a total of 5). This preserves the relative numbers of the original data sets and avoids undue impact from a few points in very sparse sets. Since the values are replicated, this approach does impact the variation measurements making estimates of distributions and similar properties better evaluated with the unaugmented data sets.

The process (200) includes applying augmentation procedure (242). The augmentation procedure includes interpolating intermediate points between the sparse data points. The spacing on the interpolated points may be determined using the mean and/or percentile distribution resolution of a person for a sound in the relevant orientation. People have different angular resolutions for sounds from different directions, e.g., from the side vs. from the front.

The process (200) includes reducing dimensionality (244). In an example, the dimensionality is reduced using principle component analysis (PCA). In an example, the dimensionality is reduced using stacked encoders with the inputs being the N-point FFT corresponding to the HRTF. A determination of the number of intermediate variables needs to be made. The number of intermediate values may be determined through trial and error. A measurement of the percentage reproduction of the original data set from the intermediate values may be a useful metric. In an example, the number of intermediate values is selected to provide 95%, 99%, and/or 99.7% of the original value after reconstruction from the intermediate values. The number of intermediates may be selected as a power of 2, such as 8 or 16. The number of intermediates may be 6.

The process (200) includes outputting intermediate values for training the second ANN (viz., output being the intermediate values and input being the directions) (246). The intermediate functions convert the inputs, e.g. angle and frequency spectrum, into the intermediate variables. The intermediate values may be generated by a linear technique, for example, those resulting from PCA. The intermediate values may also be generated by a non-linear model, for example, those resulting from the encoder part of a stacked autoencoders. These intermediate functions may be further preprocessed and/stored to decrease the calculation time. For example, the number of variables may be standardized, for example, the largest twenty relationships may be used. The values below a threshold may be substituted with zero. Applying a manual review to determine where information transitions to noise can be helpful to increase the speed of the intermediate function calculations.

The process (200) includes training neural network using intermediate values and corresponding directions (or orientations) data points (248). Here the calculated intermediate values are provided to the neural network with the corresponding output from the augmented data sets being used to provide a control. After training, manual review and pruning may be conducted to further enhance the speed and/or efficiency of the resulting neural network.

Figure 3:
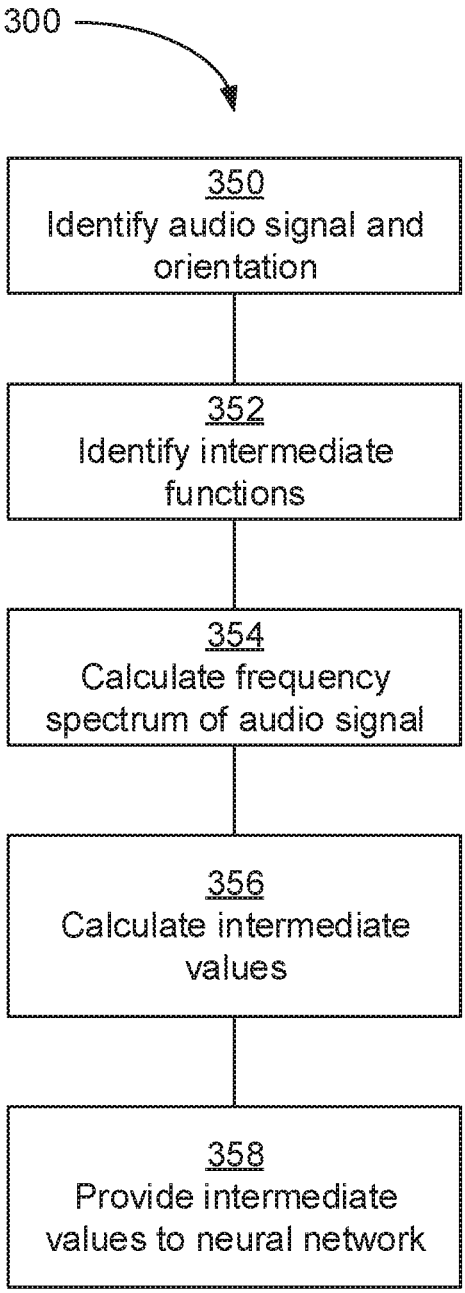
FIG. 3 shows a flowchart of a process of orienting an audio signal with the neural network consistent with the present specification.

FIG. 3 shows a flowchart of a process (300) of orienting an audio signal with the neural network consistent with the present specification. The process (300) includes: identifying the audio signal and orientation to be applied to the audio signal (350); identifying the intermediate functions (352); calculating the frequency spectrum of the audio signal (354); calculating the intermediate values (356); and providing the intermediate values to the trained neural network (358).

The process (300) includes identifying the audio signal and orientation to be applied to the audio signal (350). The audio signal may be packeted. The audio signal may be parsed. The audio signal may be divided into packet prior to additional processing. The orientation may be processed to convert from a right/left orientation to a proximal and distal side orientation depending on orientation to be applied.

The process (300) includes identifying the intermediate functions (352). The intermediate functions may be prepared in advance and stored in a memory and/or storage medium. The intermediate functions may be dynamically calculated. This may increase the delay between identifying the audio signal and providing an output.

The process (300) includes calculating the frequency spectrum of the audio signal (354). If the audio signal is in the time domain, then the audio signal may be converted to the frequency domain using a Fourier transform. In an example, a fast Fourier transform (FFT) is used. The resulting spectrum may be binned into a number of channels. The number of channels may be a power of 2. In an example, the spectrum is binned into 512 channels. The binned spectrum and the orientation information are the inputs into the intermediate functions.

The process (300) includes calculating the intermediate values (356). The binned frequency spectrum and orientation information are applied to the intermediate functions to calculate the intermediate values.

The process (300) includes providing the intermediate values to the trained neural network (358). The intermediate values are then provided as inputs to the trained neural network. The neural network outputs two audio signals. The audio signals may be in the time domain. The audio signals maybe in the frequency domain and be converted to the time domain.

The process (300) may further include applying a delay to one of the audio outputs. The process (300) may include converting from proximal/distal to left/right orientation. The process (300) may include applying a distance filter. The process (300) may include applying a distance volume correction. The two resulting audio outputs are provided to a first speaker and second speaker located near a user's ears. The result of the two coordinated audio outputs is to provide the impression of the audio signal originating from the orientation.

Figure 4:
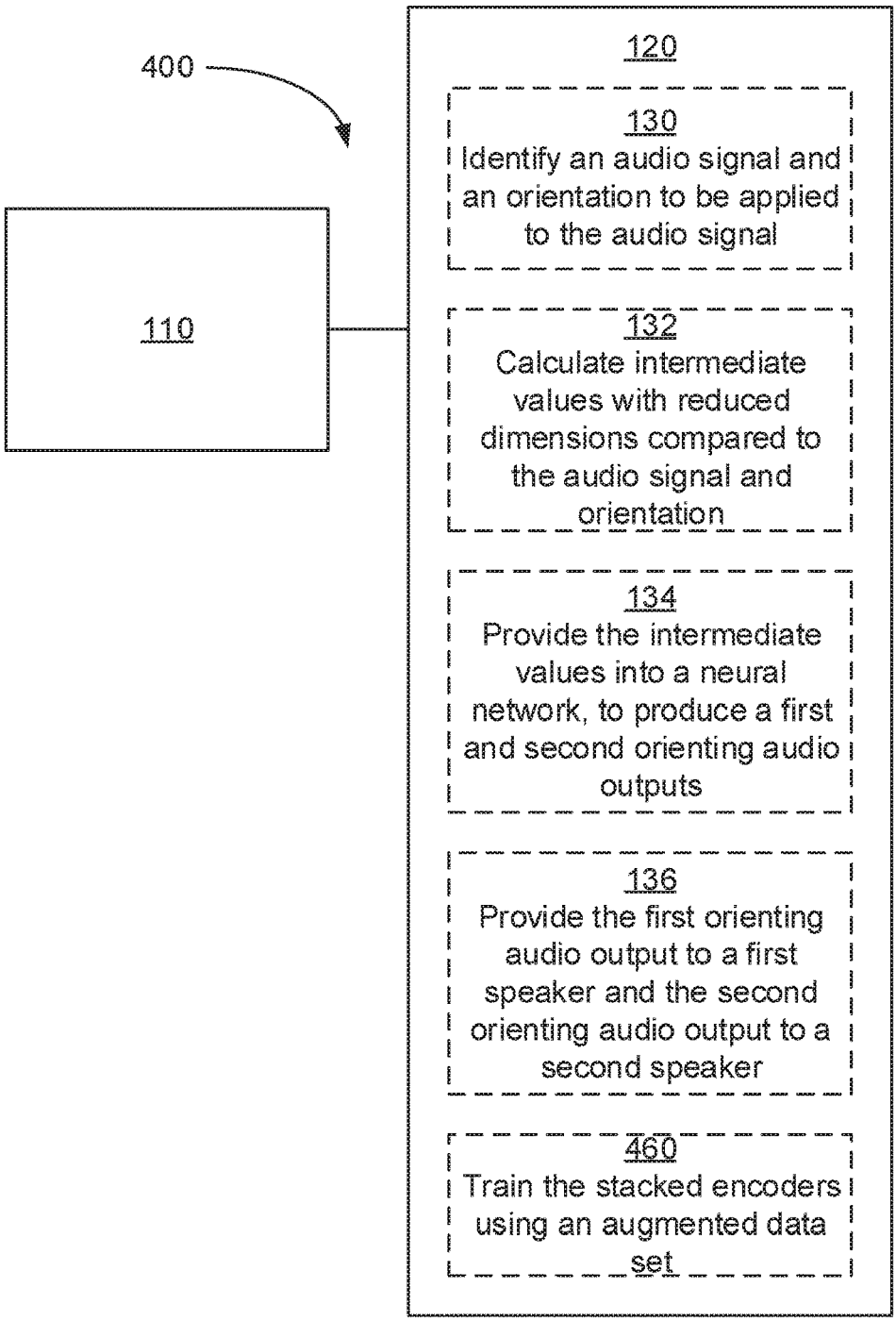
FIG. 4 shows an example of a system for creating a perception of directionality to an audio signal consistent with the present specification.

FIG. 4 shows an example of a system (400) for creating a perception of directionality to an audio signal according to an example consistent with the present specification. The system (400) includes: a processor (110) with an associated memory (120), the associated memory (120) containing instructions, which when executed cause the processor to: identify an audio signal and an orientation to be applied to the audio signal (130); calculate intermediate values to reduce the dimensions of the audio signal and orientation (132); provide the intermediate values into a neural network, to produce a first and second orienting audio outputs (134); provide the first orienting audio output to a first speaker and the second orienting audio output to a second speaker (136), wherein intermediate values are calculated from the neural network from the input direction (which has been mapped to a hypercube vertex). The intermediate values are decoded by the PCA to reconstruct the HRTF for a given orientation, or decoded by the decoder part of the stacked autoencoder to reconstruct the HRTF for a given orientation or direction.

The system (400) may operate such a time from the processor identify the audio signal and the orientation until the processor provide the first orienting audio output to the first speaker and the second orienting audio output to the second speaker are provided without delay noticeable to a user. The system (400) may operate without a look up call. The system (400) may operate without a regression and/or similar activities being performed to calculate the intermediates and the results.

The system (400) trains the stacked encoders using an augmented data set (460). The augmented data set is a sparse data set where additional data points have been interpolated between the provided (sparse) data points to reinforce the smoothness and continuous response. This avoids the data holes between the sparse data points and reduces the point to point separation to resemble the human resolution in the same region. Augmenting the data set and training the neural network may be performed prior to identifying the audio signal. Preparing the neural network in advance using the augmented data set allows verification activities to be performed prior to use. Preparing the neural network in advance also reduces the time between identification of the audio signal and orientation and the time when the output orienting audio is ready to be provided to speakers. This allows the system to operate in a real-time mode, where much of the value of this approach is realized.

Figure 5:
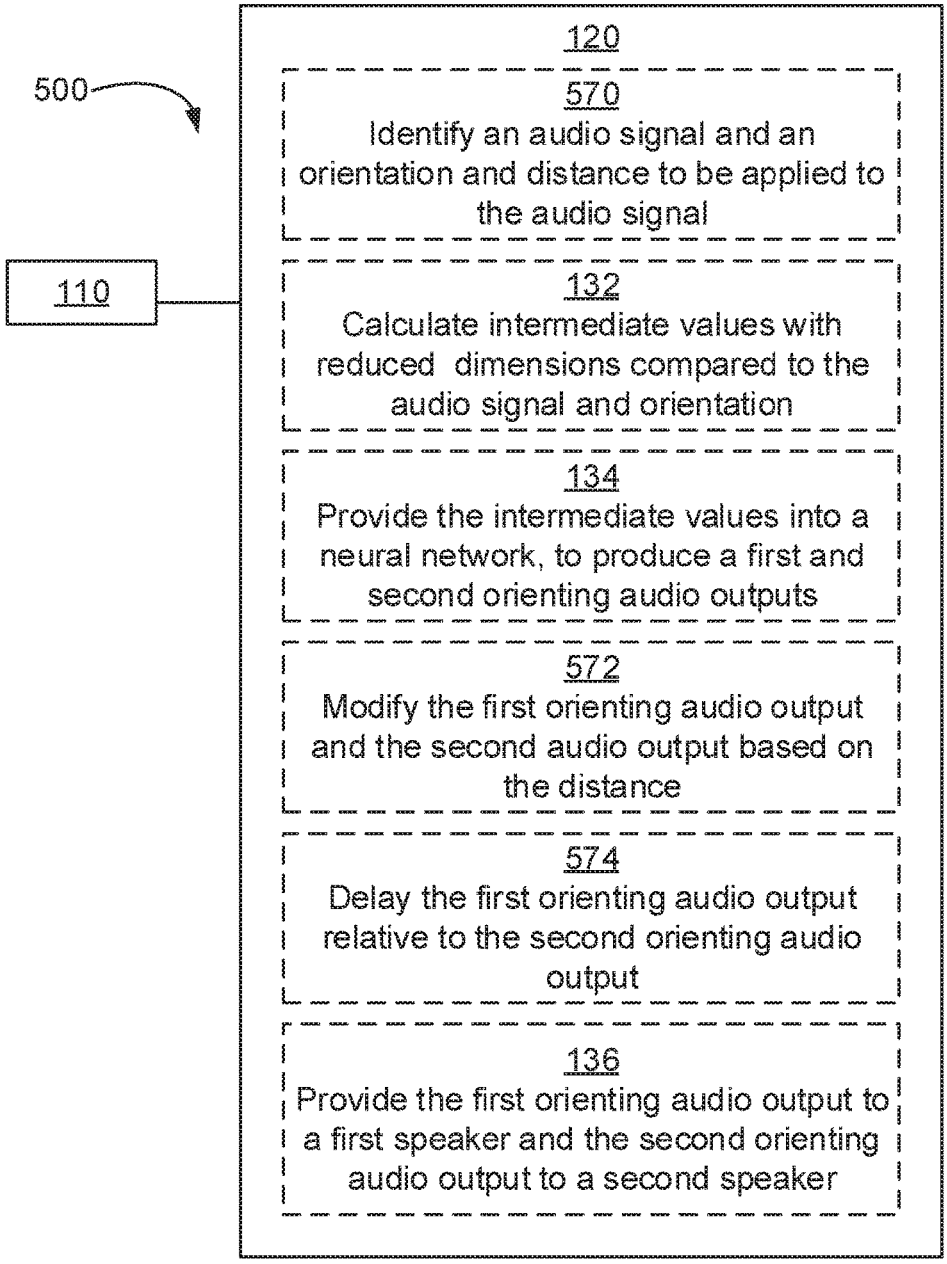
FIG. 5 shows an example of a system for creating a perception of directionality to an audio signal consistent with the present specification.

FIG. 5 shows an example of a system (500) for creating a perception of directionality to an audio signal according to an example consistent with the present specification. The system (500) comprising: a processor (110) with an associated memory (120), the associated memory (120) containing instructions, which when executed cause the processor (110) to: identify an audio signal, an orientation to be applied to the audio signal, and a distance (570); calculate intermediate values to reduce the dimensions of the audio signal and orientation (132); provide the intermediate values into a neural network, during training or inferencing, to produce a low-dimensional (PA or autoencoder-based) representation, and reconstructing the HRTF for the first and second orienting audio outputs (134) based on the decoder portion of the corresponding PCA or autoencoder; modifying the first orienting audio output and the second orienting audio output based on the distance (572); delay the first orienting audio output relative to the second orienting audio output (574); and provide the first orienting audio output to a first speaker and the second orienting audio output to a second speaker (136), wherein intermediate values are calculated using components of a principle component analysis of a blurred, augmented data set of audio inputs.

The system (500) identifies an audio signal, an orientation to be applied to the audio signal, and a distance (570). The system (500) processes the audio signal to produce first orienting audio output and the second orienting audio output. When the first and second audio outputs are heard by respective ears of a user, they provide the impression that the audio signal originates at the distance in the direction of the orientation. The system (500) may receive some of and/or the entire audio signal, orientation, and distance from an external source. The system (500) may calculate some of these values. The system may receive coordinates of the hearer and the simulated audio source and calculate an orientation and distance. The system (500) may have the user's coordinates in an environment and receive the audio signal and the coordinates of a second user in the environment. The system (500) may then calculate the relative orientation and distance between the two users prior to orienting the audio signal. In an example, the system (500) may be enabled or disabled by the first user. The system (500) may automatically disable the orienting process when the user has a single speaker or single audio channel active.

The system (500) modifies the first orienting audio output and the second audio output based on the distance (572). The modification may be an adjustment to volume. The modification may be applying a filter to the first orienting audio output and the second orienting audio output. The filter may modify the relative distribution of frequencies based on the provided distance. The modification may have a lower limit for voice communication such that it does not go below a predetermined threshold. The modification may be non-linear with respect to distance. The modification may be function of the square root of distance.

The system (500) delays the first orienting audio output relative to the second orienting audio output (574). The system (500) may use a fixed delay. The system (500) may calculate a delay based on the provided orientation. The system (500) may measure a separation and use the separation to calculate the delay. In an example, the system (500) receives separation information from a set of headphones or earbuds. The system (500) may determine the size a user's head and calculate the delay based on the size of the user's head.

The intermediate values may be calculated using no less than four and no more than eight largest components identified by the principle component analysis. In an example, the six largest components are used. In another example, the eight largest components are used.

Figure 6:
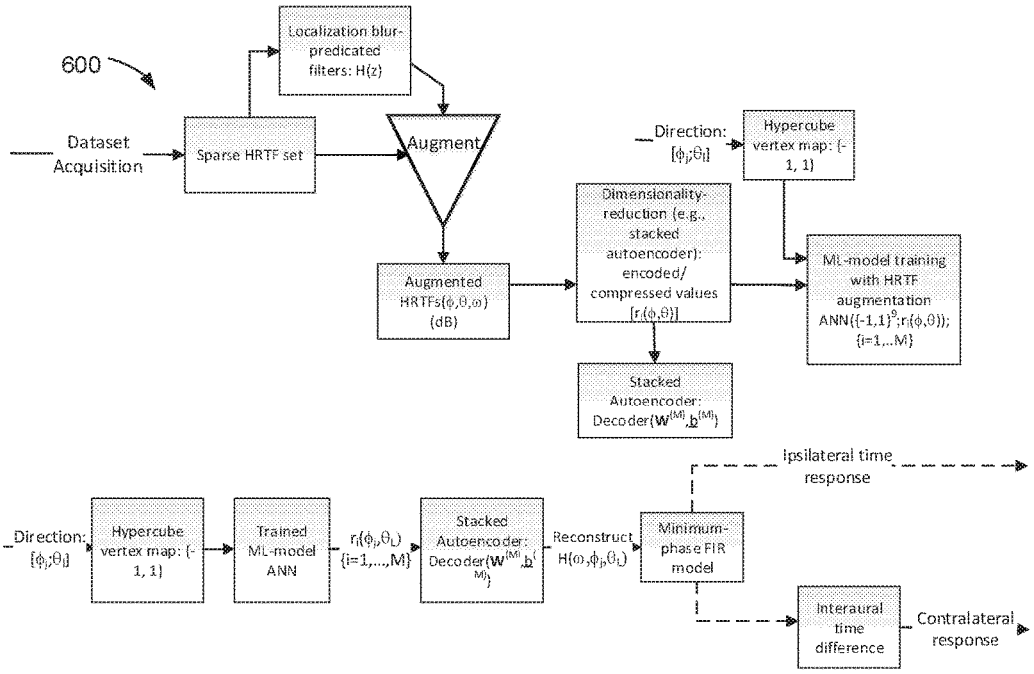
FIG. 6 shows a flow chart for training and using a neural network consistent with the specification.

FIG. 6 shows a flow chart for training and using a neural network consistent with the specification. The top portion of the flowchart depicts the activities creating the principle components and then using the principle components to train the neural network. The bottom portion of the chart shows the activities involved in providing an orientation to an audio signal.

The sparse dataset is provided as an input to create the Sparse HRTF set. This set is then blurred and augmented to form the Augmented HRTF. The augmented HRTF is then subjected to dimensionality reduction, in this case using PCA, which produces principle component (PC) scores, i.e., the linear array of values for each of the inputs used to calculate the intermediate values. The knowns of the system and the calculated intermediates are then used to train the machine learning (ML) model.

To use the system, a direction is provided and fed into the PC scores to produce the intermediate values. The intermediate values are then provided to the trained ML model neural network (from above). The PC scores can be seen feeding into this system to provide for calculation of the intermediate values. The neural network then outputs the two audio profiles for the two sides. A delay is provided for the contralateral side and the two audio signals are output to the two ears of a user.

Figure 7:
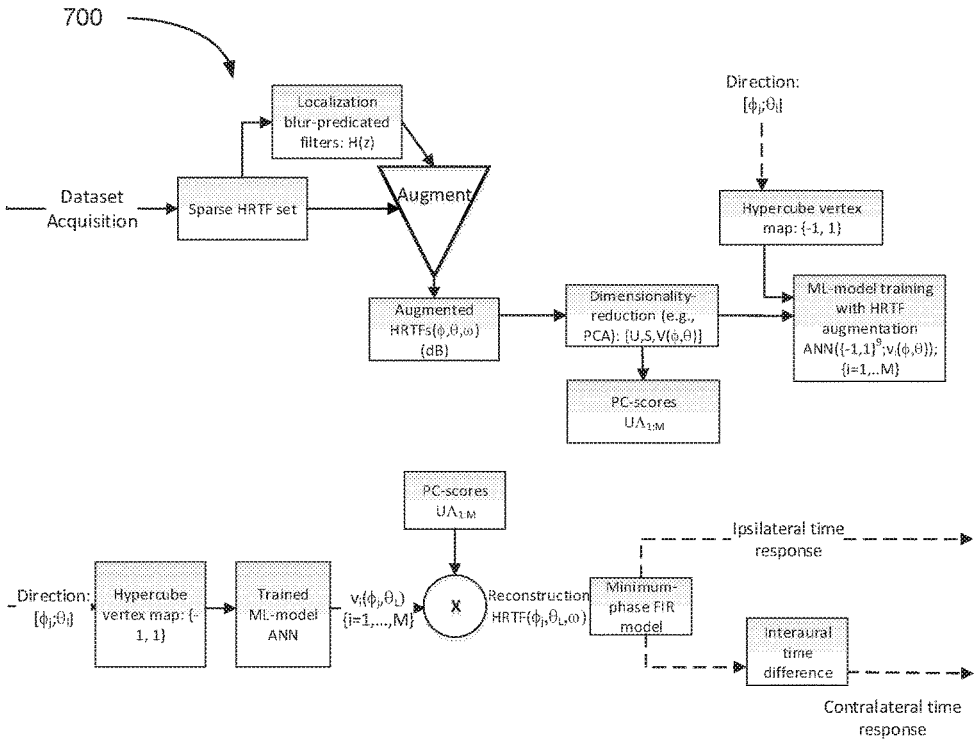
FIG. 7 shows a flow chart for training and using a neural network consistent with the specification.

FIG. 7 shows a flow chart for training and using a neural network consistent with the specification. The top portion of the flowchart depicts the activities creating the intermediate values using the stacked encoders and then using the intermediate values to with the known cases components to train the neural network. The bottom portion of the chart shows the activities involved in providing an orientation to an audio signal.

The sparse dataset is provided as an input to create the Sparse HRTF set. This set is then blurred and augmented to form the Augmented HRTF. The augmented HRTF is then subjected to dimensionality reduction, in this case using stacked encoders to perform two step downs in number of channels to output the intermediate values. The knowns of the system and the intermediate values from the stacked encoders are then used to train the machine learning (ML) model.

To use the system, a direction is provided and fed into hypercube vertex map from the stacked encoders to produce the intermediate values. The intermediate values are then provided to the trained ML model neural network (from above). The neural network then outputs the two audio profiles for the two sides. A delay is provided for the contralateral side and the two audio signals are output to the two ears of a user.

It will be appreciated that, within the principles described by this specification, a vast number of variations exist. It should also be appreciated that the examples described are only examples, and are not intended to limit the scope, applicability, or construction of the claims in any way.

What is claimed is:

1. A system for creating a perception of directionality to an audio signal, the system comprising:

a processor with an associated memory, the associated memory containing instructions, which when executed cause the processor to:

identify an audio signal and an orientation to be applied to the audio signal;

calculate intermediate values to reduce the dimensions of the audio signal and orientation, wherein intermediate values are calculated from components of a principle component analysis (PCA) of a sparse data set of audio inputs and wherein the sparse data set is augmented by applying a blurring function to the sparse data set prior to performing the principle component analysis;

provide the intermediate values into a neural network, to produce a first and second orienting audio outputs; and provide the first orienting audio output to a first speaker and the second orienting audio output to a second speaker.

2. The system of claim 1, wherein intermediate values are calculated from a six largest components of the principle component analysis (PCA).

3. The system of claim 1, wherein the processor delays the first orienting audio output relative to the second orienting audio output.

4. The system of claim 1, wherein the first and second speakers are located on opposite ears of a user.

5. The system of claim 3, wherein an orientation of the first speaker and an orientation of the second speaker are provided to the processor.

6. The system of claim 3, wherein a separation of the first and second speakers is provided to the processor.

7. The system of claim 1, further comprising identifying a distance at the processor and the processor adding a distance-based compensation to the first and second audio outputs, wherein the distance-based compensation comprises modifying a direct/reverberation ratio.

8. A system for creating a perception of directionality to an audio signal, the system comprising:

a processor with an associated memory, the associated memory containing instructions, which when executed cause the processor to:

identify an audio signal and an orientation to be applied to the audio signal;

calculate intermediate values to reduce the dimensions of the audio signal and orientation;

provide the intermediate values into a neural network, to produce a first and second orienting audio outputs;

delay the first orienting audio output relative to the second orienting audio output and provide the first orienting audio output to a first speaker and the second orienting audio output to a second speaker, wherein intermediate values are calculated from a hypercube vertex map produced by stacked encoders processing an augmented data set of audio inputs and wherein the data set was augmented by applying an augmenting routine to the data set prior to processing by the stacked encoders.

9. The system of claim 8, wherein a time from the processor identify the audio signal and the orientation until the processor provide the first orienting audio output to the first speaker and the second orienting audio output to the second speaker are provided without delay noticeable to a user.

10. A computer software product comprising a non-transitory, tangible medium readable by a processor, the medium having stored thereon a set of instructions for establishing a similarity correspondence between an input document and one or more documents in a base document collection, the instructions comprising:

a set of instructions which, when loaded into a memory and executed by the processor, cause the processor to identify an audio signal, an orientation to be applied to the audio signal, and a distance;

a set of instructions which, when loaded into a memory and executed by the processor, cause the processor to calculate intermediate values to reduce the dimensions of the audio signal and orientation;

a set of instructions which, when loaded into a memory and executed by the processor, cause the processor to provide the intermediate values into a neural network, to produce a first and second orienting audio outputs;

a set of instructions which, when loaded into a memory and executed by the processor, cause the processor to modifying the first orienting audio output and the second audio output based on the distance;

a set of instructions which, when loaded into a memory and executed by the processor, cause the processor to delay the first orienting audio output relative to the second orienting audio output; and a set of instructions which, when loaded into a memory and executed by the processor, cause the processor to provide the first orienting audio output to a first speaker and the second orienting audio output to a second speaker, wherein intermediate values are calculated using components of a principle component analysis of a blurred, augmented data set of audio inputs.

11. The product of claim 10, wherein calculating the intermediate values uses no less than four and no more than eight largest components identified by the principle component analysis (PCA).

12. The system of claim 1, wherein the sparse data set after augmentation has a data point to data point separation of no greater than 3 degrees in a front arc.

13. The system of claim 12, wherein the sparse data set after augmentation has a data point to data point separation of no greater than 1 degree in the front arc.

14. The system of claim 1, wherein the sparse data set after augmentation has a data point to data point separation of no greater than 6 degrees in a side arc.

15. The system of claim 1, wherein the sparse data set after augmentation has a first data point to data point separation in a front arc and a second, larger data point to data point separation in a side arc.

16. The system of claim 15, wherein the sparse data set after augmentation has data point to data point separations below an average human detectable separation in each associated arc.

17. The system of claim 8, wherein the data set after augmentation has a first data point to data point separation in a front arc and a second, larger data point to data point separation in a side arc.

18. The system of claim 8, wherein the data set after augmentation has a data point to data point separation of no greater than 3 degrees in a front arc.

19. The system of claim 18, wherein the data set after augmentation has a data point to data point separation of no greater than 1 degree in the front arc.

20. The system of claim 8, wherein the data set after augmentation has a data point to data point separation of no greater than 6 degrees in a side arc.

* * * * *